United States Patent [19]

Sardano et al.

[11] Patent Number: 5,004,218

[45] Date of Patent: Apr. 2, 1991

[54] RETARD FEEDER WITH PIVOTAL NUDGER SKI FOR REDUCED SMUDGE

[75] Inventors: Peter A. Sardano, Fairport; Irvin J. Kazmierczak, Rochester, both of N.Y.

[73] Assignee: Xerox Corporation, Stamford, Conn.

[21] Appl. No.: 475,493

[22] Filed: Feb. 6, 1990

[51] Int. Cl.[5] ..... B65H 3/04

[52] U.S. Cl. ..... 271/35; 271/126; 271/160; 271/165; 221/231

[58] Field of Search ..... 271/10, 35, 121, 124, 271/126, 127, 133, 134, 160, 165-167; 221/231, 232; 414/797.6, 907

[56] References Cited

U.S. PATENT DOCUMENTS

| | | | |
|---|---|---|---|
| 1,741,295 | 12/1929 | Haberer | 221/232 |
| 4,458,890 | 7/1984 | Kawazu | 271/160 X |
| 4,506,874 | 3/1985 | Preisig | 271/35 |
| 4,579,332 | 4/1986 | Larson | 271/121 X |
| 4,607,832 | 8/1986 | Abe | 271/35 X |
| 4,934,685 | 6/1990 | Shifley | 271/165 X |

*Primary Examiner*—Robert P. Olszewski
*Assistant Examiner*—Tuan N. Nguyen

[57] ABSTRACT

In a retard type botton sheet separator/feeder 80, in which the bottom of a stack of original document sheets is driven downstream to a separation nip with a retard pad 62 by the planer upper flight of a driven frictional separator bottom feed belt 50, that feeding is assisted by a normal force applying ski or shoe unit 70. The unit 70 pivotally lowers arm assembly 76 so that a large area planar bottom of a ski 72 is overlying the belt 50. The ski 72 rides on the top of the stack with low friction with a preset downward normal force. A pivotal mounting 74 thereof allows the free self-pivoting of the bottom surface of the ski 72 into continuous alignment with the plane of the top of the stack, pressing the stack between the ski and an opposing feeding belt area which is also maintained uniformly planar by a special belt supporting system. Thus the normal force is distributed evenly over a relatively large area. A dual axis gimbaled mounting 74 of the ski 72 allows the ski to adjust to various different stack heights and maintain adequate total normal force while preventing high pressure points or pressure concentrations which could cause smearing by providing a large ski area of contact with evenly applied low pressure thereover.

8 Claims, 4 Drawing Sheets

RETARD FEEDER WITH PIVOTAL NUDGER SKI FOR REDUCED SMUDGE

Cross-reference is made to the following copending applications by the same assignee with similar specification disclosures and filing dates: Ser. Nos. 07/475,530 by Peter A. Sardano and Irvin J. Kazmierczak, and 07/475,496 by Peter A. Sardano and Jeffery L. Andela.

The present invention relates to an improved retard type sheet feeder with sheet separation for sequentially feeding individual sheets from a stack of the sheets. The apparatus disclosed herein has particular utility for a bottom sheet (bottom of stack) separator/feeder, and may be used in low cost document feeders or document handlers for sequentially feeding original document sheets to be copied on a copier platen.

A bottom of stack feeder commonly has some means of applying a so-called "normal force" to press the stack down towards the bottom feeder (perpendicularly the plane of sheet feeding) with a sufficient normal force so that the bottom feeder can engage the bottom sheet with sufficient frictional force to pull out the bottom sheet of the stack and feed it in the sheet feeding direction even if the stack has such a small number of sheets that the stack weight alone does not provide sufficient normal force. Typically, such a normal force is applied by a weighted or spring loaded "bail bar", rollers, or other such stack overlying normal force applying member. Alternatively, the normal force can be applied by a vacuum system sucking the bottom sheet down against the frictional bottom feeder, but that requires a relatively expensive pneumatic system. However, such expensive pneumatic systems have been extensively used for the bottom separation and feeding of original documents, because of problems encountered with image smudging and other document wear or damage problems (further discussed below) in attempting to use simpler frictional retard type bottom separator/feeders.

It has been discovered that a system in which normal force can be consistently applied in a uniform manner with low pressure evenly distributed over a relatively large area generally corresponding to and conforming to the bottom feeder area can greatly reduce such problems and enable use of a low cost frictional retard type bottom separator/feeder more reliably for a larger range of original documents and their images.

The disclosed document feeder or handler will also be alternatively referred to herein as an "ADF" (automatic document feeder) for convenience. This disclosed document feeder application is exemplary. As shown in, for example, Xerox Corporation U.S. Pat. Nos. 4,881,729 issued Nov. 21, 1989 or 4,884,794 issued Dec. 5, 1989 or 4,849,788 issued July 18, 1989, the present apparatus can also be used in a duplex recirculating document handler, for example. The present separator/feeder apparatus may desirably be used in lieu of the feeder/separator 28 disclosed in said patents. Other current examples of retard type document feeders in which the present apparatus could be used are shown in Canon U.S. Pat. No. 4,727,398 to T. Honjo et al issued Feb. 23, 1988, U.S. Pat. No. 4,723,772 issued Feb. 9, 1988 to T. Hoji, et al, U.S. Pat. No. 4,627,709 issued Dec. 9, 1986 to T. Kitajima et al, and U.S. Pat. No. 4,544,148. Some other current examples of recirculating document handlers in general are disclosed in U.S. Pat. Nos. 4,076,408; 4,176,945; 4,278,344; 4,330,197, 4,621,801; 4,466,733; and 4,428,667.

Of particular interest is Xerox Corporation U.S. Pat. No. 4,166,614 issued Sept. 4, 1979 to T. J. Hamlin et al. It discloses a bottom sheet document stack 24 separator/feeder 32 with a retard pad 34 engaging an area of a document feed belt 33, and normal force rollers 82 engaging the top of the stack of document sheets being so separated and fed to be copied.

Although document feeding is disclosed in the example herein, the present system could also be used for copy sheet separation and feeding. Retard type feeder/separators are well known in general for copy sheet feeders.

The theory of retard feeders (sheet stack feeders with retard type sheet separation), especially those with shaped retard pads, is discussed at length and demonstrated with several examples in Xerox Corporation U.S. Pat. No. 3,768,803 issued Oct. 30, 1973 to K. K. Stange.

By way of further background, the basic or overall ADF shown herein is also the subject of Xerox Corporation U.S. Pat. No. 4,727,401, issued Feb. 23, 1988 to S. R. Partilla and E. L. Dinatale. Also, a description of one example of one copier with which this ADF (or RDH) system may be suitably used is disclosed in, for example, Xerox Corporation U.S. Pat. No. 4,708,462 on Dual Mode Duplexing issued to Denis J. Stemmle.

As to specific hardware components of the subject separator/feeder apparatus, it will be appreciated that some are known per se in other apparatus or applications. For example, it is known to provide for self-tilting of the outer rubber surface or sleeve of a roller about its mounting shaft, as in U.S. Pat. No. 4,770,550 to S. Takahashi. U.S. Pat. No. 4,496,145 to Fukui discloses a feed roller with a rubber surface "with a hardness at 30 to 50 degrees" in Col. 5. Retard pad references of possible background interest re their mounting include U.S. Pat. Nos. 2,085,248, 4,458,890, and 4,526,358, and French 2,588,537 to Saville. The latter is also noted re its nudger roll.

Of particular interest as to background re a nudger or normal force applying ski or the like is in U.S. Pat. Nos. 3,823,936, 3,869,116, 3,977,668, and 4,305,577, and Japanese 54-55971 and said French 2,588,536.

Taylor U.S. Pat. No. 3,957,366 is of interest as mentioning a guide arrangement for flattening curled sheet edges.

As xerographic and other copiers increase in speed, and become more automatic, it is increasingly important to provide higher speed yet more reliable and more automatic handling of the document sheets being copied, i.e. the input to the copier. It is desirable to reliably feed and accurately register for copying document sheets of a variety or mixture of sizes, types, weights, materials, conditions and susceptibility to damage. Yet, with this and other stack sheet feeding, it is very desirable to provide minimal double-feeding (mis-separations), misfeeding, or skewing, and minimal document jamming, wear or damage, even if the same documents are automatically fed and registered repeatedly, as for recirculating document pre-collation copying. Original document handling, particularly for delicate, valuable, thick or irregular documents, is often more difficult and critical than feeding blank or virgin sheets, particularly for documents with typing, smearable ink, fuser oil or other materials thereon susceptible of smearing or contamination of other documents by the sheet separation and feeding process. The images on documents (and/or their fusing if they are themselves copies), can change the sheet feeding characteristics and these images may be subject to damage in feeding if not properly handled, especially smearing of freshly typed typewriting ink, freshly printed ink jet printer output, etc. Original documents can vary widely in sheet size, weight, thickness, material, condition, humidity, age, etc. Documents may even have curls, wrinkles, tears, "dog-ears", cut-outs, overlays, tape, paste-ups, punched holes, staples, adhesive, or slippery areas, or other irregularities. Unlike copy sheets, which generally are from the same new clean batches and therefore of the same general condition and size, documents can often vary considerably even if they are all of the same "standard" size, (e.g. letter size, legal size, A-4, B-4, etc.). Documents, even in the same document set, may have come from different paper batches or have variably changed size with different age or humidity conditions, different imaging, etc.

Avoidance of sheet skewing during feeding and maintaining proper registration and feed timing of documents is also important. If the document is not properly fed to and registered on the platen, then undesirable dark borders and/or edge shadow images may appear on the ensuing copy sheet, or information near an edge of the document may be lost, i.e. not copied onto the copy sheet. Document misregistration, especially skewing, can also adversely affect further feeding, ejection, and/or restacking of the documents.

Even with slower copying rate copiers, it has become increasingly desirable to provide an automatic document handler (ADH) or feeder (ADF) for automatic feeding from a stack of documents, with the document handler providing all the deskewing, feeding and final registration of the documents into the copying position, and then ejecting the documents from the platen automatically.

A preferable document handling system is one that utilizes an existing or generally conventional copier optical imaging system, including the external transparent copying window (known as the platen or imaging station) of the copier. It is also desirable that the document handling system be readily removable, as by pivoting away, to alternatively allow the copier operator to conventionally manually place documents, including books, on the same copying platen. Thus, a lighter weight document handler is desirable.

In the description herein the term "document" or "sheet" refers to a usually flimsy sheet of paper, plastic, or other such conventional individual image substrate, and not to microfilm or electronic images which are generally much easier to manipulate. The "document" is the sheet (original or previous copy) being copied in the copier onto the "copy sheet", which may be abbreviated as the "copy". Related, e.g. page order, plural sheets of documents or copies are referred to as a "set". A "simplex" document or copy sheet is one having its image and page number on only one side or face of the sheet, whereas a "duplex" document or copy sheet has "pages", and normally images, on both sides, i.e., each duplex document and copy is considered to have two opposing sides, faces, or "pages" even though no physical page number may be present.

The disclosed apparatus may be readily operated and controlled in a conventional manner with conventional control systems. Some additional examples of various prior art copiers with document handlers and control systems therefor, including sheet detecting switches, sensors, etc., are disclosed in U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270, and 4,475,156. It is well known in general and preferable to program and execute such control functions and logic with conventional software instructions for conventional microprocessors. This is taught by the above and other patents and various commercial copiers. Such software may of course vary depending on the particular function and the particular software system and the particular microprocessor or microcomputer system being utilized, but will be available to or readily programmable by those skilled in the applicable arts without undue experimentation from either the provided verbal functional descriptions, such as those provided herein, or prior knowledge of those functions which are conventional, together with general knowledge in the software and computer arts. Controls may alternatively be provided utilizing various other known or suitable hard-wired logic or switching systems.

As shown in the above-cited art, the control of exemplary document and copy sheet handling systems in copiers may be accomplished by conventionally actuating them by signals from the copier controller directly or indirectly in response to simple programmed commands and from selected actuation or non-actuation of conventional copier switch inputs by the copier operator, such as switches selecting the number of copies to be made in that run, selecting simplex or duplex copying, selecting whether the documents are simplex or duplex, selecting a copy sheet supply tray, etc. The resultant controller signals may conventionally actuate various conventional electrical solenoid or cam-controlled sheet deflector fingers, motors or clutches in the copier in the selected steps or sequences as programmed. Conventional sheet path sensors, switches and bail bars, connected to the controller, may be utilized for sensing and timing the positions of documents and copy sheets, as is well known in the art, and taught in the above and other patents and products. Known copying systems utilize such conventional microprocessor control circuitry with such connecting switches and sensors for counting and comparing the numbers of document and copy sheets as they are fed and circulated, keeping track of their general positions, counting the number of completed document set circulations and completed copies, etc. and thereby controlling the operation of the document and copy sheet feeders and inverters, etc.

A specific feature disclosed herein is to provide, in a retard type sheet separating and feeding apparatus for separating and sequentially feeding individual sheets of paper or the like from the bottom of a sheet stack in a sheet feeding direction through a sheet feeding path including a retard nip defined by a retard member and an opposing frictional bottom sheet feeding member engaging the bottom of the stack, assisted by a normal force applying member for pressing on the top of the stack with a normal force, the improvement wherein said normal force applying member comprises a ski member with a relatively large and substantially planar stack engagement ski area, and a ski pivotal mounting system providing vertical movement of said ski into pressing engagement of said ski area with the top of the stack with a normal force perpendicular said sheet feeding path in response to the loading of a sheet stack into said sheet separating and feeding apparatus, said ski pivotal mounting system also providing self-adjusting tilting of said ski area about orthogonal axes of movement for self-leveling of said ski area relative to said sheet feeding path to allow said ski to adjust to different stack heights and to maintain adequate total normal force while preventing high pressure concentrations which could increase smearing by providing a large ski area of contact with evenly applied low pressure thereover.

Further features which may be provided by the system disclosed herein, individually or in combination, include those, wherein said ski pivotal mounting system includes a pivoted actuating arm, and wherein said normal force applying ski member is mounted to the end of said pivoted actuating arm by a dual axis gimbaled mounting allowing said ski member to freely self-level by said pressing engagement with the top of the sheet stack for uniformly normal distributed application of said normal force thereto, and/or wherein in operation said opposing frictional bottom sheet feeding member has a relatively large substantially planar area of engagement with the bottom of a stack being fed and said ski area directly overlies a substantial portion of said substantially planar area of engagement and is substantially parallel therewith, and wherein said pressing engagement of said ski area with the top of the stack is closely adjacent to and upstream of said retard member and/or wherein said pressing engagement of said ski area with the top of the stack is closely adjacent to and upstream of said retard member in said sheet feeding direction, and wherein said normal force ski area extends substantially across the transverse width of said opposing frictional bottom sheet feeding member, and/or wherein said retard member is a large area frictional elastomeric pad and said ski area is a low friction planar surface of generally corresponding area, and/or wherein said opposing frictional bottom sheet feeding member is a large and substantially planar sheet engagement area of a frictional belt sheet feeder providing a bottom sheet feeder for original documents to be imaged on a copier, and wherein said opposing frictional bottom sheet feeding member comprises a generally planar area of a frictional sheet feeding belt engaging the bottom of the sheet stack being separated, and wherein said ski area engages the top of said sheet stack being separated overlying a major portion of said planar area of said frictional sheet feeding belt closely adjacent to and upstream of said retard member in said sheet feeding direction, and wherein said retard member at least partially overlies another portion of said same planar area of said frictional sheet feeding belt, and/or wherein said opposing sheet feeding member comprises a planar area of a frictional sheet feeding belt with supporting means for maintaining and supporting said planar area comprising a multiplicity of small and closely spaced interdigitated rollers in a close staggered multipoint pattern of rolling engagement with the back of said frictional belt in said planar area of said belt, and wherein said ski area engages the top of said sheet stack being separated overlying a major portion of said planar area of said frictional sheet feeding belt.

All references cited in this specification, and their references, are incorporated by reference herein where appropriate for appropriate teachings of additional or alternative details, features, and/or technical background.

Various of the above-mentioned and further features and advantages of the invention will be apparent from the apparatus and its operation described in the specific example below. Thus, the present invention will be better understood from the following description of this exemplary embodiment thereof, including the drawing figures (approximately to scale) wherein.

Figure 1:
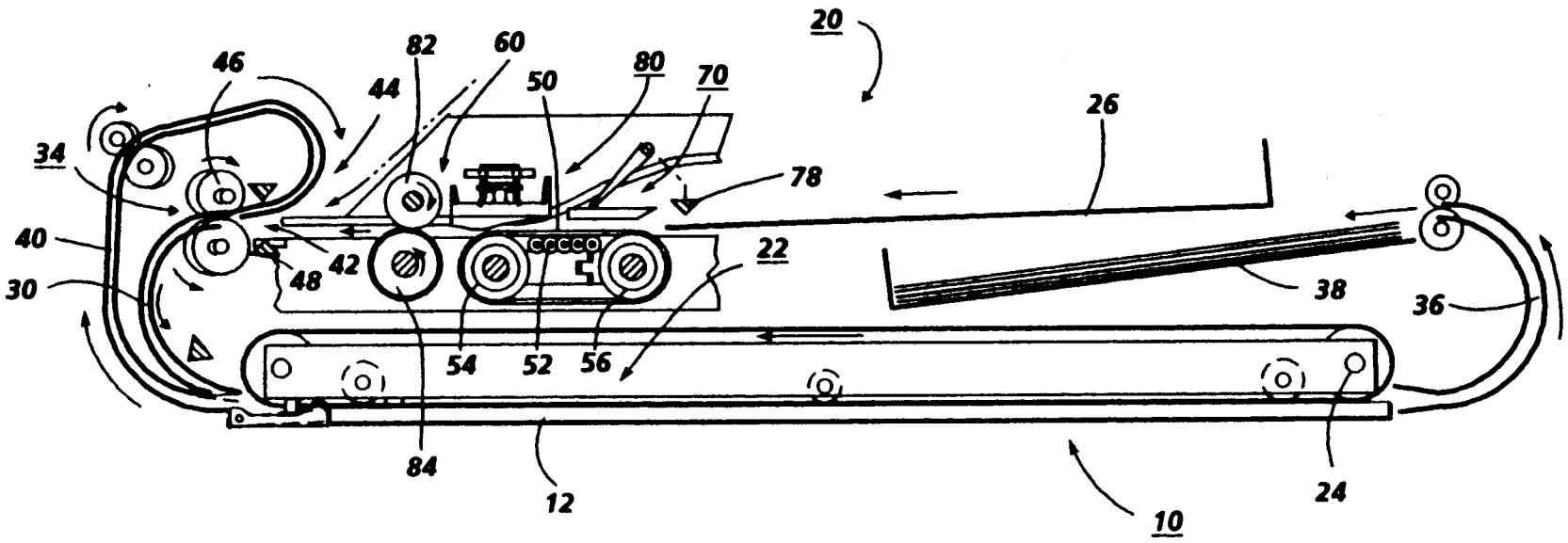
FIG. 1 is a partly schematic side view of an exemplary document handler incorporating one example of separator/feeder apparatus in accordance with the present invention.
Figure 2:
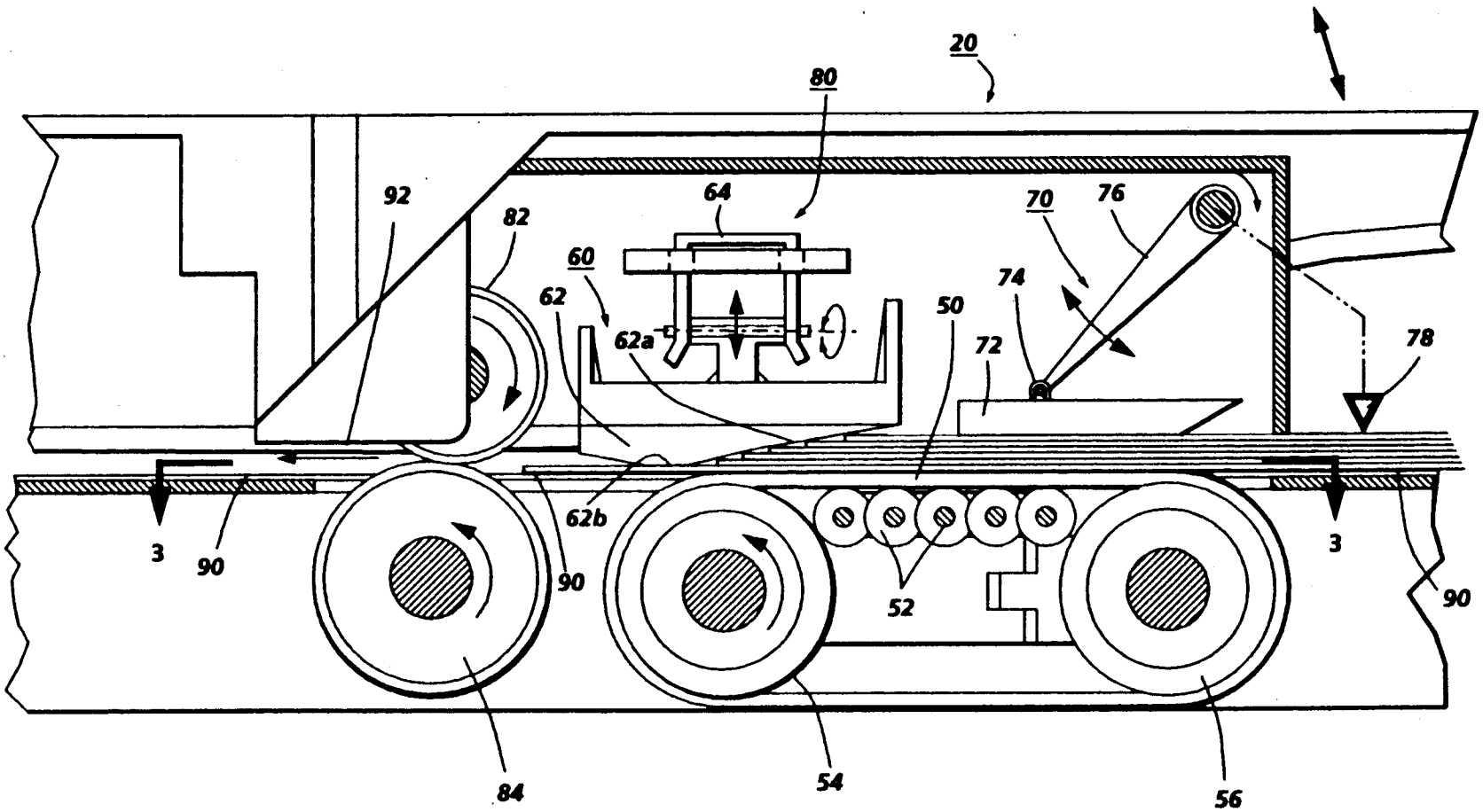
FIG. 2 is an enlarged cross-sectional side view of the separator/feeder of the ADF of FIG. 1. For illustration clarity a relatively small plurality of sheets is shown being separated, and illustrated here with exaggerated sheet thickness.
Figure 3:
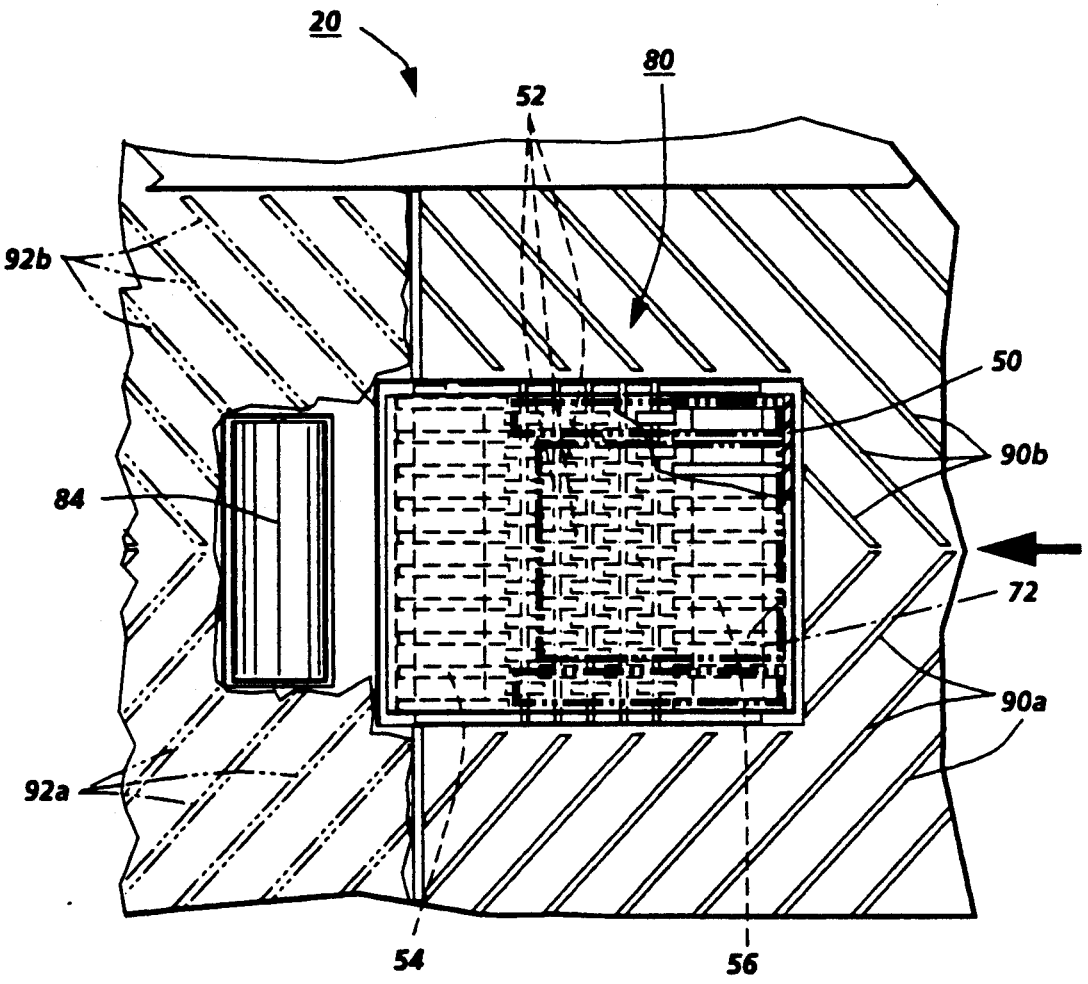
FIG. 3 is a partial top view of the separator/feeder of FIG. 2 taken along the line 3—3 of FIG. 2 but also showing in phantom thereover the engagement area of the normal force or stack hold-down ski.

Details of one exemplary sheet feeder/separator apparatus 80 in accordance with the invention are shown in one application being used in an ADF 20 for document feeding in FIG. 1, and shown per se, enlarged, in FIGS. 2 and 3. It will be appreciated that the sheet feeder/separator 80 may be utilized with various other document handlers or other applications, and/or with almost any copier, including various of those cited herein. Thus the only portion of an exemplary copier 10 illustrated here is the copier platen 12 shown in FIG. 1.

The exemplary overall ADF 20 here disclosed in FIG. 1 is otherwise like that of the above-cited U.S. Pat. Nos. 4,881,729 or 4,884,794 or 4,849,788, and thus not be redescribed here. Documents sheets to be copied by the copier 10 from a document stack are separated and sequentially fed towards the platen 12 by the ADF 20. The document is then driven over the platen 12 surface into a desired copying registration position by the platen belt transport system 22, with its drive 24. The document is then ejected by the platen transport 22 from the platen 12 after it is copied.

The set or stack of original documents to be fed and copied may be initially loaded stacked face-up into the document tray 26. They are sequentially fed out from the bottom of the stack by the sheet separator/feeder 80 (to be further described). All document sheets are initially fed downstream through a simplex path 30 to the acquisition entrance to the belt transport system 22, adjacent the platen 12. The initial portion of this simplex path 30, (just downstream of the separator/feeder 80) includes a side edge registration and deskewing system 34. This system 34 may be a known crossed-rolls 46,48 and edge guide system.

The ADF unit 20 may be utilized as a non-recirculating automatic document feeder by not returning the documents to the tray 26 after copying. After copying, documents may be ejected, as shown, from the opposite, downstream, end of the platen into an output inverting path 36 which inverts the documents and ejects them up into an output restacking tray 38.

If the documents are duplex documents requiring inversion, they may be inverted in a duplex path 40. The duplex path 40 here is a continuous unidirectional loop which starts and ends at the same side of the platen. The duplex path 40 here smoothly merges into the simplex path 30 at a path intersection 42 upstream of the edge registration and deskewing system 34 but downstream of the separator/feeder 80. At this intersection 42 each duplex document has been turned over twice from its orientation coming off the platen, and is feeding in the downstream direction into the simplex path 30, i.e., in the same feeding direction as a document being initially fed from the tray 26, as shown by the arrows in FIG. 1. An alternate single sheet bypass input 44 may also be provided there, as shown by the illustrated dot-dash arrow. All three said paths 30, 40, 44 are entering the same side edge registration and deskewing system 34, and may also use the same sheet lead edge sensor, shown there schematically as a diamond or arrowhead shape.

Conventionally, additionally connected to the copier controller are additional document sheet lead and/or trail edge sensors strategically positioned around the document path, including a stack input sensor 78.

Describing now in further detail the specific example illustrated in the Figures of the separator/feeder 80, there is schematically shown therein a retard type sheet separator/feeder in which the bottom of the stack of sheets is engaged and driven downstream to a nip with a retard pad 62, for separation and feeding of only the bottom sheet, by the generally planer upper flight of a driven frictional separator feed belt 50.

That feeding by the moving belt 50 is assisted by a normal force applying ski or shoe unit 70. The unit 70 is actuated by sensor 78 after the document stack is inserted to pivotally lower arm assembly 76 with a ski or shoe 72 pivotally 74 mounted to the end thereof. The ski 72 thereby rides on the top of the stack over the belt 50 with a preset downward normal force pressing the stack down against the belt 50 under the ski 72. The relatively large area and location of this ski 72 normal force engagement is shown from above in phantom in FIG. 3, and from the side in FIG. 2. The bottom of the ski 72 is planar and of relatively low friction material to allow the stack to slide thereunder. The freely pivotal intermediate mounting 74 thereof allows the downward normal force to be applied via the arm 76, yet be applied uniformly to the documents by allowing the free self-pivoting of the bottom surface of the ski 72 into alignment with the plane of the top of the stack, which is only indirectly controlled by the belt 50 mounting and lower sheet guide surface (ribs) 90. Thus the normal force is distributed evenly over a relatively large area of the documents, and high pressure points which could cause smearing of document images are reduced. What is also provided here is a freely dual axis gimbaled mounting 74 of the ski 72 which allows the ski to adjust to various different stack heights, and maintain adequate total normal force while preventing high pressure points or concentrations which could cause smearing with a large ski area of contact, and to evenly applied low pressure thereover. This may be provided at 74 by a rotatable pin connection on one axis to allow pivoting with lose (oversize) pin holes or straps to also allow a substantial free tilt range on the other, orthogonal, axis. Other alternatives, such a snap fit ball and socket connection, may be used.

The ski 72, being located just upstream of the retard nip with the retard pad 62, and of approximately the same transverse width, also helps flatten down the stack there. The feeding of the stack into the retard nip may also be assisted by two downwardly angled elongated rubber band like members on opposite sides of the ski 72 engagement area, shown in phantom in FIG. 3.

The elastomeric frictional retard pad 62 is part of a special retard pad mounting assembly 60, wherein the retard pad 62 is linearly vertically movable up and down (perpendicular the sheet path), as shown by the large linear double headed arrow in FIG. 2, on an inverted "U" channel or other suitable pad holding clip 64, which is vertically (only) movable through corresponding apertures or guide slots in a fixed frame mounting plate, as shown in FIG. 2. Thus, the clip 64 cannot rotate or tilt. The pad 62 may be spring loaded down with a desired nip force towards a sheet separation nip adjacent the downstream end of the belt 50 upper flight. This illustrated retard pad mounting assembly 60 also provides for relatively unrestricted lateral or transverse pivoting of the retard pad 62 for its self-leveling and nip force uniformity in that axis, across the belt 50, as shown by the smaller circular double headed arrow shown about the illustrated pivot pin axis mating with the clip 64. However, movement or rotation of the retard pad 62 on the orthogonal axis (the sheet path direction) is prevented by this mounting 60. This maintains the retard pad 62 in the correct position and maintains constant the illustrated small angle of the upstream lower surface **62*a* of the retard pad 62 which provided the initial stack separation entrance and resists what is called "slug feeding" of plural sheets into the final retard nip, defined here by the small lowermost flat area 62*b* of the retard pad 62. By thus preventing any pivoting or other movement of the retard pad in the sheet feeding direction, there is also decreased sensitivity to the positioning of the retard pad relative to the feed belt 50 (or to a feed roller, if one is used instead). Smudging may also be reduced. Also, "slip-stick" type noise generation might be reduced. This low cost and simple mounting assembly 60 may be made from molded plastic parts such as a polycarbonate, with 30% glass fibers. No lubrication is required. As shown, the retard pad 62 operative lower surface is generally convex, with a small angle, preferably less than 15 degrees, generally planar stack shingling entrance wedge formed by the upstream lower surface 62*a*, narrowing up to the apex at 62*b*, and then preferably a larger exit clearance angle after this primary retard area 62*b***.

After a bottom sheet has been so separated from the rest of the stack, it is fed on downstream into the nip of take-away drive roller 82, and take-away idler roller 84, which feeds the document sheet on towards the platen. To resist skew inducement in the take-away nip, the take-away idler roller 84 here is preferably a solid plastic or metal cylinder coated with a 1 mm sleeve of urethane having a 45 Shore A durometer. With this surface self-leveling, the idler 84 does not have to be axially pivotally mounted to be self-leveling on the take-away drive roller 82 nip surface. The idler 84 can be a simple (but coated as described) apertured solid delrin sleeve rotating on a fixed axis solid metal shaft. The take-away drive roller 82 may be a solid metal cylinder coated with a 2 mm sleeve of isoprene or other suitable elastomer.

Also disclosed is a special system for maintaining the elastomeric frictional separator feed belt 50 flat and positively supporting the belt flight before and through its engagement with the retard pad 62. A plurality of 5 common small diameter closely spaced idlers 52 are provided by multiple disks on small shafts are all mounted in one plane behind the belt 50 to simulate a flat backing plate, but without the frictional drag of a flat plate under a frictional belt. They provide rolling contact with the belt. The shafts for the discs 52 may be additionally center supported to resist deflection. The adjacent said idlers 52 are slightly transversely offset to be interdigitated and thus provide and even closer pattern of supporting planar contact points under the belt, i.e., minimum center to center distances, yet not transitioning irregularities. Similarly thin and interdigitating but larger diameter plural idler disks are provided as part of the end and driving rollers 54 and 56, respectively, as shown in phantom in the top view of FIG. 3. All these components may be a low cost plastic parts assembly, around which the belt 50 is tensioned by its assembly therein. This belt mounting system helps reduce image or second side smudge in this friction-retard feeder. A truly flat and fully continuous belt backing surface would not be as desirable or contact-maintainable as the multiplicity of supporting points provided here. While the general concept of plural belt backing rollers is used in many large platen transport belts document handlers and other large belt feeders, per se, it provides particular advantages in this system and application.

Another disclosed feature of the illustrated separator/feeder 80 is the sheet corner edge guiding and flattening transverse ribs system 90, 92, particularly visible in FIG. 3. This may be used in various apparatus for feeding flimsy sheets of paper or the like in a sheet feeding direction through a sheet feeding path. Such sheet feeding paths normally include, as here opposing spaced apart sheet feeding guide baffles, usually flat or with ribs extending in the sheet movement direction. Particularly where there is a relatively large spacing between opposing baffle surfaces, and dog-eared or curled up edge documents need to be fed without damage. The disclosed system 90, 92 utilizes the fact that a sheet will have its two opposing edge corners feeding through the two opposite sides of said sheet feeding path. The system here reduces feeding difficulties where some such sheet corners have dog-eared or curled up edges, as is often the case with original documents.

The lower sheet feeding guide baffle surface here has a plurality of spaced apart and slightly vertically extending sheet-engaging ribs 90. The sheet normally freely slides over these ribs 90, and the ribs 90 preferably extend over substantially the entire feeding baffle area except for the small area where the sheet is being engaged by the separator/feeder 80 and the take away rollers so as to have influence over the sheet during the full entrance into the ADF 20. The small rib height and relatively close rib spacing is such that no sheet lead edge corner will ever be in a stubbing condition with any rib. These ribs 90 are preferably linear, as shown, but as shown they are divided into two opposingly diagonal sets of plural ribs 90*a* and 90*b* on the respective opposite sides of the sheet feeding path, merging and extending diagonally out from the centerline of the sheet feeding path and the separator/feeder 80. The first plurality of first diagonal sheet engaging ribs 90*a* extend diagonally in said sheet feeding direction but also extending diagonally out towards the edge of their respective side of the sheet feeding path. Thus these diagonal ribs can iron out towards that one side the downward dog-ears or curls in the corner of the sheet in that side of the sheet feeding path. Likewise, the opposite sheet corner, if it is curled, can be engaged by the oppositely diagonal second plurality of sheet engaging ribs 90*b* in the other side of the sheet feeding path, extending diagonally out towards the outside of that other side of said sheet feeding path, for ironing out towards that other side any dog-ears or curls in that corner of the sheet in that other side of the sheet feeding path. The document sheet separator/feeder 80 preferably engages sheets in substantially the same plane as the plane defined by the upper surfaces of the sheet engaging ribs 90.

The upper baffle surface here has corresponding ribs 92, in two correspondingly diagonal sets 92*a* and 92*b*. At least some of the ribs 92 have substantially greater height and are interrupted in the area of the document sheet separator/feeder 80 to allow the document sheet separator/feeder 80 to extends therebetween. This upper sheet feeding guide baffle is preferably pivotally openable relative to the other sheet feeding guide baffle.

Figure 4:
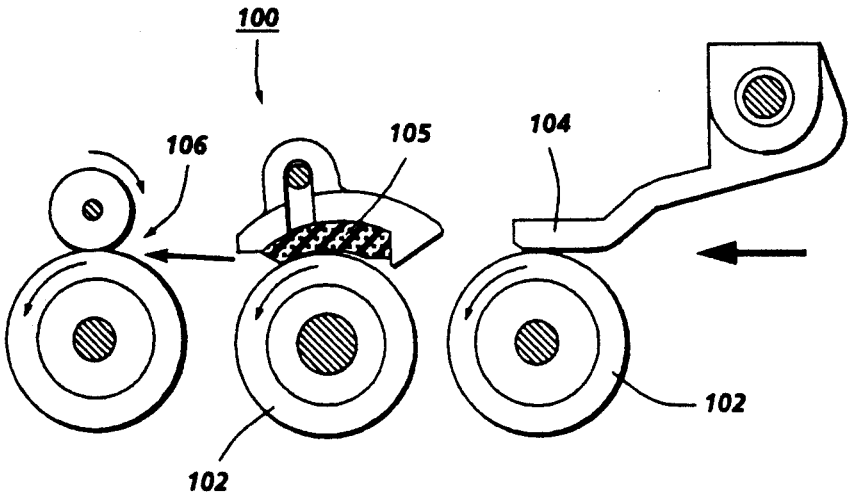
FIG. 4 PRIOR ART
FIG. 4 is a schematic side view of the prior art (so labeled) Xerox Corporation "5028" Copier document retard feeder configuration.
Figure 5:
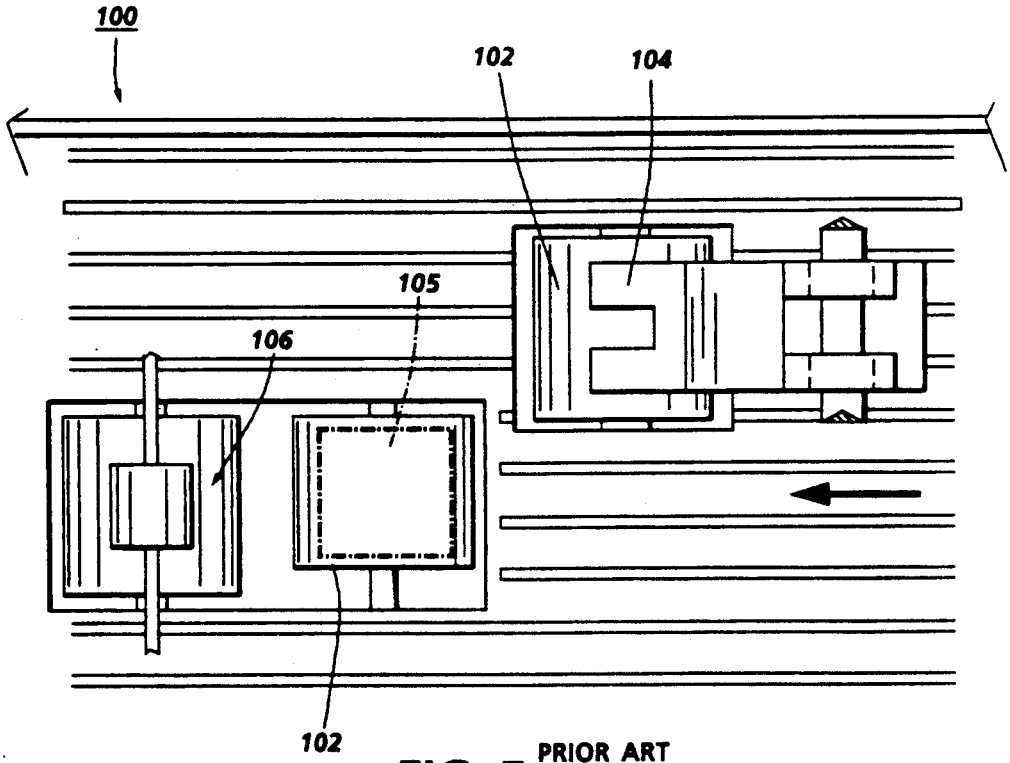
FIG. 5 PRIOR ART
FIG. 5 is a top view of the prior art retard feeder of FIG. 4.

Referring to FIGS. 4 and 5, there is schematically shown portions of the prior art Xerox Corporation "5028" Copier document retard separator/feeder 100. This separator/feeder 100 configuration has a laterally offset bottom of stack input feed roller 102. A normal force arm 104 integral (non-pivital) forked end presser plate area is lowered on top of the stack over this input roller 102. The sheets are fed in and separated by a separate and laterally offset retard feed roller (not a belt) 104 and an overlying concave surface retard pad 105. Separated sheets are fed on by a takeaway rollers nip 106.

While the embodiment disclosed herein is preferred, it will be appreciated from this teaching that various alternatives, modifications, variations or improvements therein may be made by those skilled in the art, which are intended to be encompassed by the following claims:

I claim:

1. In a retard type sheet separating and feeding apparatus for separating and sequentially feeding individual sheets of paper or the like from the bottom of a sheet stack in a sheet feeding direction through a sheet feeding path including a retard nip defined by a retard member and an opposing frictional bottom sheet feeding member engaging the bottom of the stack, assisted by a normal force applying member for pressing on the top of the stack with a normal force, the improvement wherein:

said normal force applying member comprises a ski member with a relatively large and substantially planar stack engagement ski area, and a ski pivotal mounting system providing vertical movement of said ski into pressing engagement of said ski area with the top of the stack with a normal force perpendicular said sheet feeding path in response to the loading of a sheet stack into said sheet separating and feeding apparatus, said ski pivotal mounting system also providing self-adjusting tilting of said ski area about orthogonal axes of movement for self-leveling of said ski area relative to said sheet feeding path to allow said ski to adjust to different stack heights and to maintain adequate total normal force while preventing high pressure concentrations which could increase smearing by providing a large ski area of contact with evenly applied low pressure thereover, wherein said ski pivotal mounting system includes a pivoted actuating arm, and wherein said normal force applying ski member is mounted to the end of said pivoted actuating arm by a dual axis gimbaled mounting allowing said ski member to freely self-level by said pressing engagement with the top of the sheet stack for uniformly normal distributed application of said normal force thereto.

2. The retard type sheet separating and feeding apparatus of claim 1, wherein in operation said opposing frictional bottom sheet feeding member has a relatively large substantially planar area of engagement with the bottom of a stack being fed and said ski area directly overlies a substantial portion of said substantially planar area of engagement and is substantially parallel therewith.

3. The retard type sheet separating and feeding apparatus of claim 1 wherein said pressing engagement of said ski area with the top of the stack is closely adjacent to and upstream of said retard member.

4. The retard type sheet separating and feeding apparatus of claim 1, wherein said normal force ski area extends substantially across the transverse width of said opposing frictional bottom sheet feeding member.

5. In a retard type sheet separating and feeding apparatus for separating and sequentially feeding individual sheets of paper or the like from the bottom of a sheet stack in a sheet feeding direction through a sheet feeding path including a retard nip defined by a retard member and an opposing frictional bottom sheet feeding member engaging the bottom of the stack, assisted by a normal force applying member for pressing on the top of the stack with a normal force, the improvement wherein:

said normal force applying member comprises a ski member with a relatively large and substantially planar stack engagement ski area, and a ski pivotal mounting system providing vertical movement of said ski into pressing engagement of said ski area with the top of the stack with a normal force perpendicular said sheet feeding path in response to the loading of a sheet stack into said sheet separating and feeding apparatus, said ski pivotal mounting system also providing self-adjusting tilting of said ski area about orthogonal axes of movement for self-leveling of said ski area relative to said sheet feeding path to allow said ski to adjust to different stack heights and to maintain adequate total normal force while preventing high pressure concentrations which could increase smearing by providing a large ski area of contact with evenly applied low pressure thereover, wherein said pressing engagement of said ski area with the top of the stack is closely adjacent to and upstream of said retard member, wherein said retard member is a large area frictional elastomeric pad and said ski area is a low friction planar surface of generally corresponding area.

6. The retard type sheet separating and feeding apparatus of claim 1, wherein said opposing frictional bottom sheet feeding member is a large and substantially planar sheet engagement area of a frictional belt sheet feeder providing a bottom sheet feeder for original documents to be imaged on a copier.

7. The retard type sheet separating and feeding apparatus of claim 1, wherein said opposing frictional bottom sheet feeding member comprises a generally planar area of a frictional sheet feeding belt engaging the bottom of the sheet stack being separated, and wherein said ski area engages the top of said sheet stack being separated overlying a major portion of said planar area of said frictional sheet feeding belt closely adjacent to and upstream of said retard member in said sheet feeding direction, and wherein said retard member at least partially overlies another portion of said same planar area of said frictional sheet feeding belt.

8. In a retard type sheet separating and feeding apparatus for separating and sequentially feeding individual sheets of paper or the like from the bottom of a sheet stack in a sheet feeding direction through a sheet feeding path including a retard nip defined by a retard member and an opposing frictional bottom sheet feeding member engaging the bottom of the stack, assisted by a normal force applying member for pressing on the top of the stack with a normal force, the improvement wherein:

said normal force applying member comprises a ski member with a relatively large and substantially planar stack engagement ski area, and a ski pivotal mounting system providing vertical movement of said ski into pressing engagement of said ski area with the top of the stack with a normal force perpendicular said sheet feeding path in response to the loading of a sheet stack into said sheet separating and feeding apparatus, said ski pivotal mounting system also providing self-adjusting tilting of said ski area about orthogonal axes of movement for self-leveling of said ski area relative to said sheet feeding path to allow said ski to adjust to different stack heights and to maintain adequate total normal force while preventing high pressure concentrations which could increase smearing by providing a large ski area of contact with evenly applied low pressure thereover, wherein said opposing sheet feeding member comprises a planar area of a frictional sheet feeding belt with supporting means for maintaining and supporting said planar area comprising a multiplicity of small and closely spaced interdigitated rollers in a close staggered multi-point pattern of rolling engagement with the back of said frictional belt in said planar area of said belt, and wherein said ski area engages the top of said sheet stack being separated overlying a major portion of said planar area of said frictional sheet feeding belt.

* * * * *